United States Patent [19]

Miyakawa et al.

[11] Patent Number: 4,614,698

[45] Date of Patent: Sep. 30, 1986

[54] TWO-COMPONENT ELECTROPHOTOGRAPHIC DEVELOPER WITH MAGNETIC CARRIER

[75] Inventors: Nobuhiro Miyakawa, Ashiya; Koji Yano, Tokyo; Kazuo Yamamoto, Tokyo; Teruaki Higashiguchi, Tokyo; Yoshinobu Kawakami, Tokyo, all of Japan

[73] Assignee: Mita Industrial Co., Ltd., Osaka, Japan

[21] Appl. No.: 802,315

[22] Filed: Nov. 27, 1985

[30] Foreign Application Priority Data

Nov. 30, 1984 [JP] Japan ..... 59-251653

[51] Int. Cl.[4] ..... G03G 9/14

[52] U.S. Cl. ..... 430/106.6; 430/108; 430/111

[58] Field of Search ..... 430/106.6, 108, 111

[56] References Cited

U.S. PATENT DOCUMENTS 3,914,181 10/1975 Berg et al. ..... 430/106.6 X
4,414,322 11/1983 Miyakawa et al. ..... 430/106.6
4,416,964 11/1983 Miyakawa et al. ..... 430/106.6

FOREIGN PATENT DOCUMENTS 56-19059 2/1981 Japan ..... 430/108

*Primary Examiner*—Roland E. Martin
*Attorney, Agent, or Firm*—Sherman and Shalloway

[57] ABSTRACT

A two-component electrophotographic developer for use in developing a latent electrostatic image of a low potential. The developer is composed of a mixture of a magnetic carrier of spherical sintered ferrite particles having raised and depressed portions attributed to the primary particles on their surface, a median size of from 30 to 50 micrometers, an apparent density of less than 2.6 g/cc and an electric resistance, measured in the form of a magnetic brush, of from $6\times10^4$ to $2.5\times10^6$ ohms and chargeable toner particles having a volume inherent resistivity of at least $1\times10^{13}$ ohms-cm and a specific inductive capacity of from 4 to 6. In a preferred embodiment, the chargeable toner particles have a median size of from 10 to 14 micrometers and are substantially free from particles having a particle diameter of not more than 5 micrometers. The developer can give an image of a high density, a high resolution and excellent gradation without brush marks.

14 Claims, 7 Drawing Figures

TWO-COMPONENT ELECTROPHOTOGRAPHIC DEVELOPER WITH MAGNETIC CARRIER

BACKGROUND OF THE INVENTION

1. Field of the Invention

This invention relates to a two-component developer for images of a low potential, and more specifically, to a developer capable of developing a latent electrostatic image of a low potential to a toner image having a high density and excellent quality.

2. Description of the Prior Art

In electrophotography using a two-component magnetic developer, a chargeable toner and a magnetic carrier are mixed and the two-component mixture is fed onto a development sleeve equipped with a magnet therein to form a magnetic brush composed of this mixture. By bringing the magnetic brush into frictional contact with an electrophotographic plate bearing a latent electrostatic image, a toner image is formed on the electrophotographic plate. The chargeable toner, upon frictional contact with the magnetic carrier, is charged to a polarity opposite to that of the latent electrostatic image on the electrophotographic plate. The toner particles on the magnetic brush are attracted and adhered to the latent electrostatic image by the Coulomb force whereby the latent electrostatic image is developed. On the other hand, since the magnetic carrier is attracted by the magnet within the sleeve and its charge is of the same polarity as the charge of the latent electrostatic image, the magnetic carrier remains on the sleeve. In order to form a clear image of high density, it is important to provide a sufficient relative difference in speed between the electrophotographic material and the magnetic brush so that the electrophotographic plate is rubbed sufficiently with the magnetic brush.

Generally, an iron powder carrier is widely used as the magnetic carrier, but the iron powder carrier still has many defects. Specifically, a two-component developer containing the iron powder carrier has the defect that the rising of the development sensitivity curve (representing the potential difference between the electrostatic image and the development sleeve versus the density of the image) is steep, the image has poor gradation, and the reproducibility of a halftone is poor. Furthermore, the developer containing the iron powder carrier sometimes forms a hard magnetic brush which may possibly injure the electrophotographic layer. Another defect is that in copying a solid portion using such a developer, the resulting image has a defect called brush marks which are many rows of slender, short white lines extending in the rubbing direction of the brush. In addition, since the iron powder carrier is sensitive to humidity, the development characteristics will be changed by the effect of humidity, or the carrier itself tends to develop rust. Still another problem is that a high torque is required for driving the magnetic brush.

It has been proposed recently to use ferrites, particularly soft ferrites, as a magnetic carrier for the two-component developer. The ferrite carrier has the advantage that its residual magnetization is low, the torque required for the driving of the magnetic brush is relatively low, and the degrading tendency of its various characteristics under environmental conditions is small. On the other hand, partly because the ferrite carrier has a higher electrical resistance than the iron powder carrier, it has the disadvantage that during development, a trouble of carrier migration which is the migration of the carrier to the photographic layer occurs, or an edge effect is produced in the formed image.

In recent years, amorphous silicon-type photoconductors have aroused interest for use as a photosensitive plate for electrophotography because they have a high surface hardness and a sensitivity to light of long wavelengths, and their sensitivity itself is good.

In spite of the above superior characteristics of amorphous silicon, it is difficult both technically and economically to provide a sufficiently thick layer of the amorphous silicon photoconductor. The thickness of the amorphous silicon conductor layer now available is limited to a relatively narrow range of from 10 to 35 microns which is much smaller than that of a selenium photosensitive layer. Partly because of the small thickness of the amorphous silicon conductor layer, the surface potential on the photoconductive layer during charging is limited to 200 to 400 V which is much lower than that on the selenium photosensitive layer. If the charge potential is forcibly increased, dielectric breakdown occurs in the photosensitive layer, and the resulting charge image has a low potential contrast. Accordingly, when a latent electrostatic image is developed with an ordinary two-component developer, the toner image has a reduced image density. If an attempt is made to increase the image density forcibly, scattering of the toner occurs, or the fog density increases.

SUMMARY OF THE INVENTION

It is an object of this invention to provide a two-component developer capable of forming a toner image of high density and high quality by using a photosensitive material on which to form a latent electrostatic image of a low potential, such as an amorphous silicon photoconductor.

Another object of this invention is to provide a two-component developer for a low potential contrast capable of forming a toner image of high density while preventing the occurrence of brush marks.

Still another object of this invention is to provide a two-component developer which contains a ferrite carrier having a relatively low electric resistance and yet can prevent the occurrence of brush marks.

According to this invention, there is provided a two-component electrophotographic developer composed of a mixture of (a) a magnetic carrier of spherical sintered ferrite particles having raised and depressed portions attributed to the primary particles on their surface, a median size of from 30 to 50 micrometers, an apparent density of less than 2.6 g/cc and an electric resistance, measured in the form of a magnetic brush, of from 6 to $10^4$ to $2.5\times10^6$ ohms and (b) chargeable toner particles having a volume inherent resistivity of at least $1\times10^{13}$ ohms-cm and a specific inductive capacity of from 4 to 6.

According to another aspect of this invention, there is provided a two-component electrophotographic developer composed of a mixture of (a) a magnetic carrier of spherical sintered ferrite particles having raised and depressed portions attributed to the primary particles on their surface, a median size of from 30 to 50 micrometers, an apparent density of less than 2.6 g/cc and an electric resistance, measured in the form of a magnetic brush, of from $6\times10^4$ to $2.5\times10^6$ ohms and (b) chargeable toner particles having a volume inherent resistivity of at least $1\times10^{13}$ ohms-cm and a specific inductive capacity of from 4 to 6, said toner particles (b) having a median size of from 10 to 14 micrometers and being substantially free from particles having a particle diameter of not more than 5 micrometers.

DETAILED DESCRIPTION OF PREFERRED EMBODIMENTS

Electrophotographic Process

Figure 1:
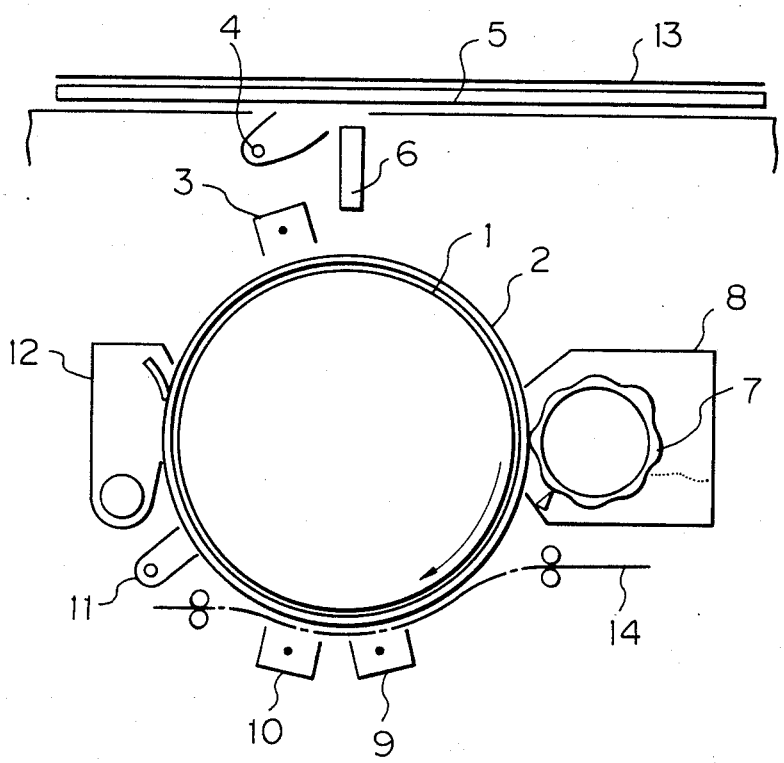
FIG. 1 is a view for illustrating an electrophotographic process suitable for application of the developer of this invention.

With reference to FIG. 1, an electrophotographic process to which the two-component developer of this invention can be suitably applied will be described. An amorphous silicon-type photoconductor layer 2 is provided on the surface of a rotating metallic drum 1. Around the drum 1 are provided a corona discharge device 3 for main charging, an image exposing mechanism comprised of a lamp 4, a document supporting transparent plate 5 and an optical system 6; a developing mechanism 8 having a toner 7, a corona discharge device 9 for toner transfer, a corona discharge device 10 for paper separation, a charge eliminating lamp 11, and a cleaning mechanism 12 in the order stated.

First, the photoconductor layer 2 is charged to a specified polarity by the corona discharge device 3. Then, a document 13 to be copied is illuminated by the lamp 4. The photoconductor layer 2 is exposed to the light image of the document via the optical system 6 to form a latent electrostatic image corresponding to the image of the document. The latent electrostatic image formed on the photoconductor layer 2 is developed with the toner 7 by the development mechanism 8. A receptor sheet 14 is supplied so as to contact the drum surface at the position of the corona discharge device 9 for toner transfer, and a corona discharge of the same polarity as the electrostatic image is applied to the back of the receptor sheet 14 to transfer the toner image to the receptor sheet 14. The receptor sheet 14 having the toner image transferred thereto is electrostatically peeled from the drum by the corona discharge device 10 for paper separation, and then sent to a processing zone such as a fixing zone (not shown).

After the transfer of the toner image, the entire surface of the photoconductor layer 2 is exposed by the charge eliminating lamp 11 to erase the residual charge, and then, the residual toner is removed by the cleaning mechanism 12.

Magnetic Carrier

One important feature of the present invention is to use a magnetic carrier composed of sintered ferrite particles having a low electric resistance and a specified surface structure for developing a low potential contrast image on the aforesaid amorphous silicon photoconductor.

Among various magnetic carriers, a ferrite carrier is specifically used in the present invention. It is known that since the ferrite carrier has a lower specific gravity and a lower saturation flux density than an ordinary iron powder carrier, a brush formed from it is soft, and this brings about the advantage that a development sleeve or a magnet within the sleeve requires only a relatively low torque for rotation during development. Furthermore, when the ferrite carrier is used, the electrical characteristics of a magnetic brush of the developer are stable over an extended period of time, and the occurrence of a spent toner is reduced.

As stated hereinabove, however, the ferrite carrier particles have a volume inherent resistivity about 20 to 30 times as high as the iron powder carrier. Thus, it has been found that a two-component magnetic developer composed of an ordinary ferrite carrier and a chargeable toner may give a toner image of high density when used in developing a latent electrostatic image on a selenium-type photosensitive material, but gives only an image of a very low density when used to develop an electrostatic image on an amorphous silicon photosensitive material.

A marked characteristic of the ferrite carrier used in this invention is that it is composed of sintered and reduced ferrite particles having a dynamic electric resistance, as a magnetic brush, of from $6.0\times10^4$ to $2.5\times10^6$ ohms, particularly from $1.0\times10^5$ to $7.2\times10^5$ ohms. Ordinary ferrite carriers generally have a high dynamic electric resistance of at least $1\times10^9$ ohms with a volume inherent resistivity of at least $1\times10^{10}$ ohms-cm. Recently, Japanese Laid-Open Patent Publication No. 48774/1984 discloses that a molded article of ferrite containing a divalent metal oxide component in a mole ratio of not more than 0.85 to $Fe_2O_3$ is used as a carrier for an electrophotographic developer. The volume inherent resistivityh of the carrier disclosed in the Japanese patent document is certainly lower than the ordinary ferrite, but is still on the order of $8.5\times10^6$ to $2\times10^9$ ohms-cm. The mere use of this carrier component proves to be unsatisfactory for the purpose of developing a latent electrostatic image on an amorphous silicon-type photoconductor to a toner image of high density. In contrast, according to this invention, the use of sintered ferrite particles having an electric resistance of $6.0\times10^4$ to $2.5\times10^6$ ohms in combination with a toner having a high specific inductive capacity enables a toner image of a high density to be formed from an electrostatic image on the amorphous silicon-type photoconductor.

In the present invention, the dynamic electric resistance of the magnetic brush denotes the electric resistance of the magnetic brush which is measured dynamically under the development conditions involving the use of the magnetic brush. It is determined by the following method. An aluminum electrode drum having the same size as the electrophotographic drum is provided instead of the electrophotographic drum and a developer is supplied to a development sleeve to form a magnetic brush. The magnetic brush is brought into frictional contact with the electrode drum. A voltage is applied between the sleeve and the drum, and an electric current flowing between them is measured. The resistance value is calculated by using the measured electric current.

In the determination of the electric resistance, a voltage of 50 V is applied in the case of using a developer composed of a toner and a carrier, and a voltage of 20 V is applied in the case of forming the magnetic brush only from the carrier. The electric current is measured under the development conditions for a developing device provided in the copying machine used (such as the distance between the drum and the sleeve, and the moving speed of the magnetic brush). It will be understood therefore that the resistance value determined on the basis of this measurement is one which has directly to do with the developing device in the copying machine used. The electric resistance determined by this measuring method will be referred to hereinbelow as the D-S resistance. Let the charge potential be E, the development current be i and the electric resistance of the magnetic brush of the developer be R, a relation shown by the following equation is generally considered to hold good.

$$E=iR \quad (1)$$

If it is assumed that the density of the toner is proportional to the development current i, one may get as large as development current i as possible for a photosensitive material having a low charge potential (E) by lowering the resistance (R) of the magnetic brush. Furthermore, one may think of lowering the electric resistance of the magnetic carrier, that is the D-S resistance, in order to decrrease the electrical resistance R of the magnetic brush of the developer.

Figure 2:
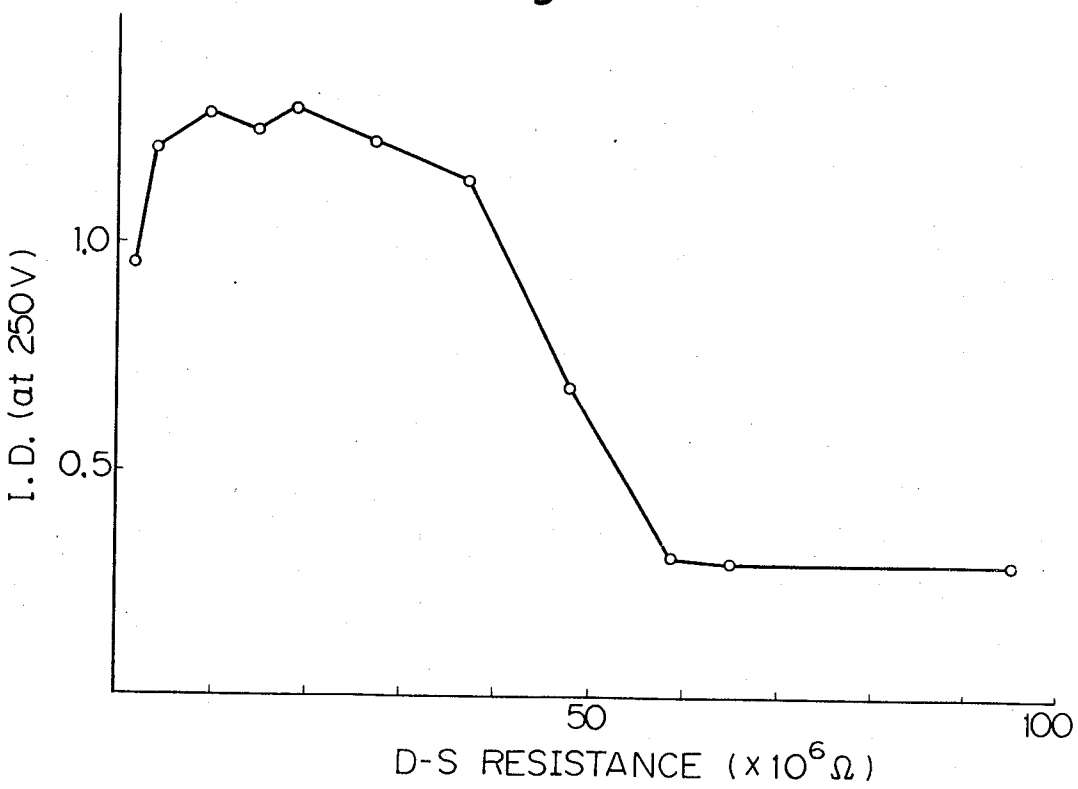
FIG. 2 is a graphic representation showing the relation between the D-S resistance of the developer and the image density (ID)

The present inventors, however, found previously that the relation between the dynamic electric resistance of a magnetic brush of a developer composed fo a carrier and a toner under development conditions and the density of a toner image is not hyperbolic as shown by equation (1) above, but that there is a flex point at a certain electric resistance value, and below this flex point, the density of an image increases strikingly. FIG. 2 plots the relation between the resistance of a magnetic brush of a developer under dynamic developing conditions and the density of the toner image formed in the invention for which the present inventors previously filed a patent application (Japanese Patent Application No. 84000/1984). It will be clear from this graph that the aforesaid critical point occurs with a combination of an amorphous silicon photosensitive material and a ferrite carrier developer.

As is clearly seen from FIG. 2, too, to form a toner image having a high density and high quality on an amorphous silicon-type photosensitive material, the magnetic brush of the developer should have an electric resistance under dynamic developing conditions (D-S resistance) of from $4\times10^6$ ohms to $5\times10^7$ ohms, especially from $8\times10^6$ to $4\times10^7$ ohms.

As a matter of course, the resistance of the entire magnetic brush of the developer depends upon the resistance of the carrier particles and the resistance of the toner particles. The electric resistance of the toner particles exerts a great influence on the transfer of the toner image from the surface of the photosensitive layer to a receptor sheet. If the volume resistivity of the toner particles is lower than $1\times10^{13}$ ohms-cm, the transfer efficiency of the toner particles decreases and the toner image scatters or has a broadened contour at the time of transfer. Consequently, the volume resistivity of the toner particles cannot be made lower than the specified limit. From this viewpoint, it is effective to use a carrier having a relatively low electric resistance.

The most serious problem which arises when lowering the electric resistance of the magnetic carrier is that brush marks occur when a charge image is developed. There are two possible causes of the occurrence of brush marks. One is that the charge is partially leaked during rubbing of the magnetic brush against the latent electrostatic image in the solid portion, and the leaked portions become white. The other is that after the toner adheres to the latent electrostatic image in the solid portion, the toner is partly scraped off, and such portions become white. In the case of using a ferrite carrier having a low electric resistance, brush marks occur presumably because of the first-mentioned leakage of charge.

According to this invention, the occurrence of brush marks can be completely prevented by using spherical sintered ferrite particles having raised and depressed portions attributed to the primary particles on their surface.

Figure 3:
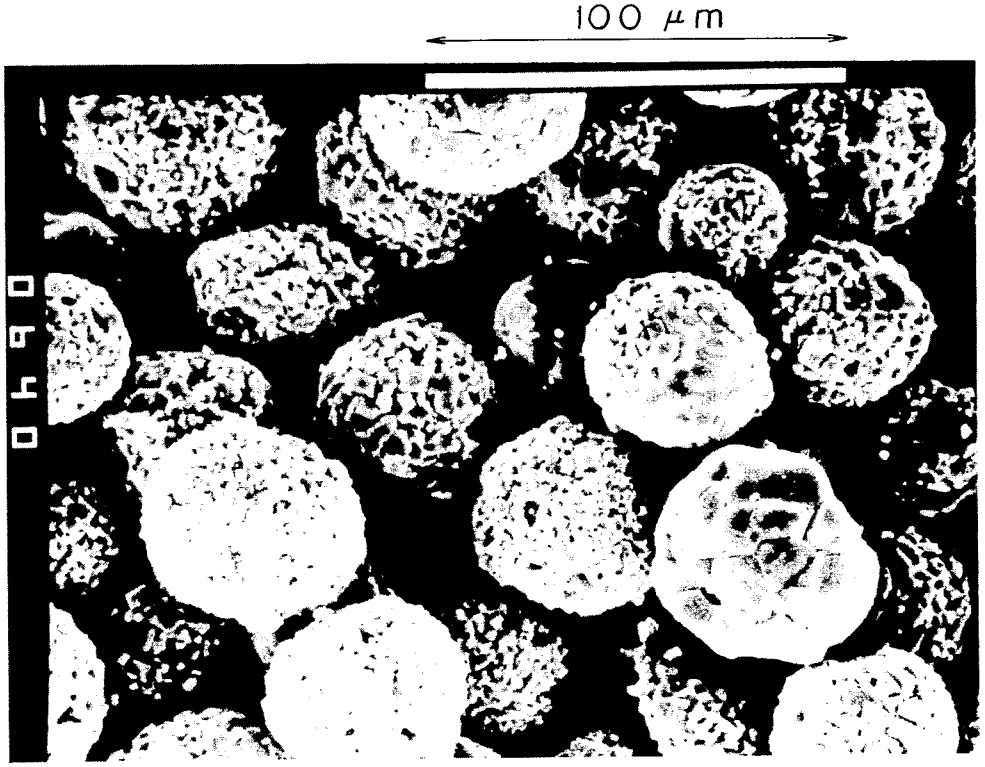
FIG. 3 is an electronmicrograph (450X) showing the surface shape of ferrite carrier particles having an apparent density of 2.36 g/cc.
Figure 4:
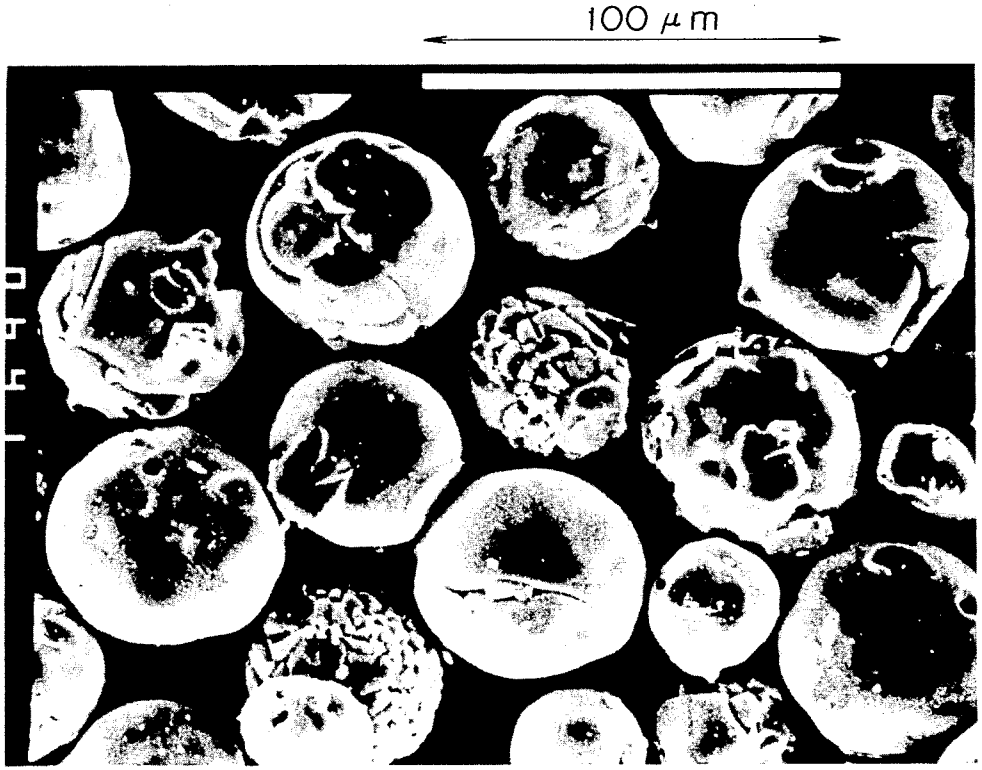
FIG. 4 is an electromicrograph (450X) showing the surface shape of ferrite carrier particles having an apparent density of 2.72 g/cc.

FIG. 3 is a scanning electron micrographh of the spherical sintered ferrite particles used in this invention, and FIG. 4 is a scanning electron micrography of ordinary sintered ferrite particles having a smooth surface. A comparison of these micrographs clearly show that the sintered ferrite particles used in this invention have fine raised and depressed portions on their surfaces because the surfaces of the primary particles still retain their outer shape.

The sintered ferrite particles have a median size (diameter corresponding to a weight of 50%) of generally 30 to 50 micrometers, particularly 40 to 45 micrometers, and having regard to their uneven surface mentioned above, they have an apparent density (JIS Z-2504-1966) of less than 2.6 g/cc, particularly 2.30 to 2.50 g/cc.

According to this invention, the use of sintered ferrite particles having a low electric resistance and a fine uneven surface as a carrier component, the density of the image can be markedly increased while preventing the occurrence of brush marks.

Figure 5:
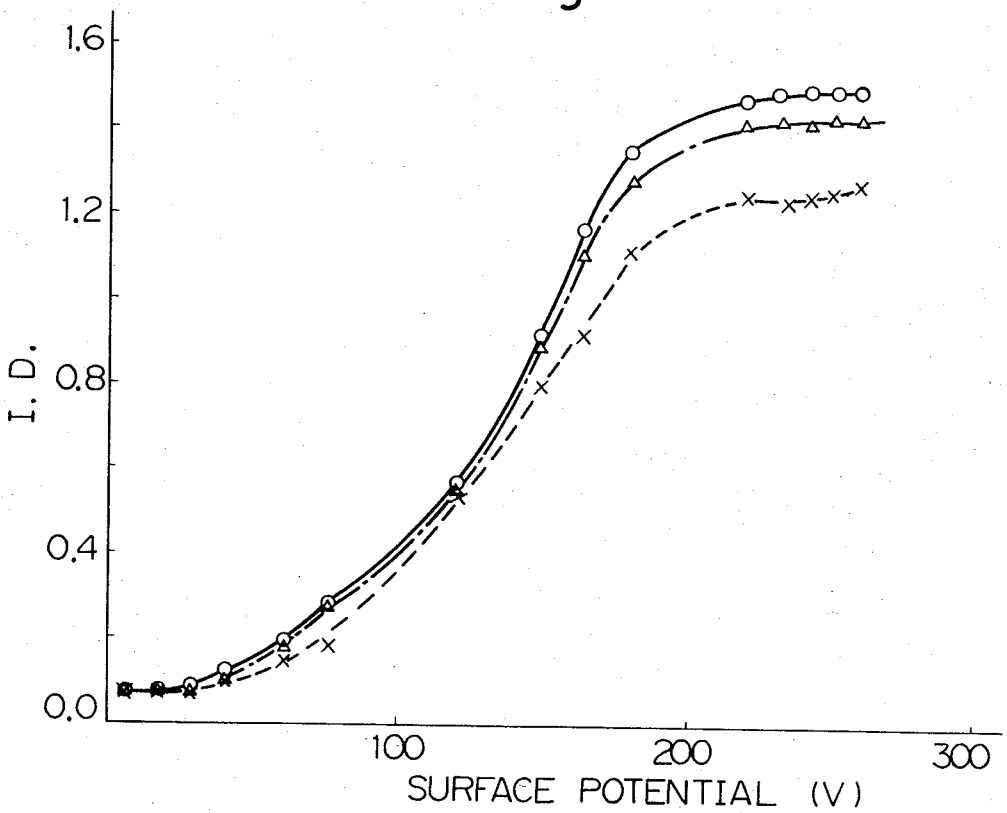
FIG. 5 is a graphic representation showing the image density (ID) measured with varying surface potentials of an amorphous silicon photosensitive material using the ferrite carriers shown in FIGS. 3 and 4 and a toner having a high dielectric constant.

FIG. 5 shows the results of measurement of the density of an image with varying surface potentials of an amorphous silicon photoconductor layer using a developer composed of ferrite particles having the shape and structure shown in FIG. 3 or ferrite particles having the shape and structure shown in FIG. 4 and a toner component to be described.

In FIG. 5, the circular marks show the results obtained with a combination of ferrite particles having the shape and structure shown in FIG. 3 and a toner having a high dielectric constant (specific inductive capacity 5.1); the triangular marks show the results obtained with a combination of the same carrier as above and an ordinary toner (specific inductive capacity 3.4); and X marks show the results obtained with a combination of ferrite particles having the shape and structure shown in FIG. 4 and the ordinary toner.

These results of measurement show that the image density is increased over a wide potential range by using the magnetic carrier used in this invention. This is truely unexpected. It is expected that sintered ferrite particles as the magnetic carrier will be more effective for the prevention of the leakage of a charge image as their surfaces are more smooth and they have a shape nearer to a true sphere. It is further more expected that as the sintered ferrite particles have a shape nearer to a true sphere, there is a larger surface area which contributes to the triboelectric charging with the toner particles and the toner charge increases. Contrary to such expectations, it has now been found in accordance with this invention that sintered ferrite particles having an uneven surface is more effective for preventing the leakage of a charge image and increasing the image density.

No reason has yet been full elucidated for this unexpected advantage. However, the present inventors assume it to be for the following reason. When the magnetic carrier and the chargeable toner are mixed, they are charged respectively to their inherent polarities. Since the sintered ferrite particles used in this invention are relatively electrically conductive, a charge which occurs triboelectrically in a raised portion of the carrier moves to a depressed portion of the carrier where the charge builds up. As a result of movement of the charge, the raised portion is in condition for recharging. Consequently, the toner particles are charged effectively and the raised portions are maintained in a non-charged state. Leakage between charges of different polarities would thus be prevented.

The ferrite carrier used in this invention can be obtained by sintering fine particles (primary particles) of ferrite in such a way that the sintered particles have a particle size within the range specified hereinabove and become spherical particles having raised and depressed portions on their surface attributed to the primary particles, and reducing the sintered ferrite particles, preferably in an atmosphere of hydrogen, so that the D-S resistance of the sintered ferrite particles is within the range specified above. The composition of ferrite is known. Generally, soft ferrites are used. Illustrative of such ferrites are Zn-type ferrite, Ni-type ferrite, Cu-type ferrite, Mn-type ferrite, Mn-Zn type ferrite, Mn-Mg type ferrite, Cu-Zn type ferrite, Ni-Zn type ferrite and Mn-Cu-Zn type ferrite, although the invention is not limited to these specific examples. Preferred ferrites are Cu-Zn type or Cu-Zn-Mn type ferrites composed of, in atomic weight percent, 35 to 65% of Fe, 5 to 15% of Cu, 5 to 15% of Zn and 0 to 0.5% of Mn.

These ferrites generally have a fine primary particle diameter of 0.5 to 7 micrometers. The ferrite particles are granulated to almost spherical particles by such means as spray granulation, and then sintered by such means as firing. The particle diameter of the ferrite particles during spray granulation is prescribed so that the median size of the resulting sintered spherical particles will become 30 to 50 micrometers. The sintering temperatures is prescribed so that sintering among the primary particles takes place but the primary particles on the outside surface of the resulting spherical particles retain their original shape, or in other words, the primary particles on the surface of the sintered spherical particles do not form a continuous molten phase. The sintering temperature varies depending upon the composition of the ferrite. With the Cu-Zn type or Cu-Zn-Mn type ferrites, the firing temperature in the prior art is 1200° to 1400° C., but in the present invention, temperatures at least 100° C. lower than the conventional firing temperatures, generally 900° to 100° C. are used.

The sintered ferrite particles are reduced at a temperature of 300° to 500° C., particularly 340° to 420° C., for example in a hydrogen stream. The treating time required varies according to the temperature or the amount of hydrogen passed. Generally, the time is selected from 30 minutes to 1 hour so that the D-S resistance of the product is within the range described hereinabove. As a result of the reduction, metal components present at least in the surface portion of the sintered ferrite particles are converted to oxides of a lower valency state and this is considered to lower the electric resistance of the sintered ferrite partices. Desirably, the reducing treatment is carried out in a hydrogen atmosphere. It can also be carried out using carbon monoxide.

Toner

The toner particles used in this invention have a specific inductive capacity ($\epsilon$), measured by the method to be described in detail, of as high as 11.5 to 12.5. When the difference between the specific inductive capacity ($\epsilon$) of the photosensitive material and the specific inductive capacity ($\epsilon$) of the toner is large as in this case, a triboelectrical charge is easily generated between the toner and the photosensitive material. By the triboelectrical charging, the toner also adheres to a nonimage area of the photosensitive material. The adhesion of the toner to the nonimage area could be prevented to some extent by applying a development bias voltage between the photosensitive material and a development sleeve. But when the difference between the specific inductive capacities of the two is large as above, the bias voltage should be considerably high. With the amorphous silicon-type photosensitive material, the potential contrast of a charge image thereon is inherently low. Hence, if the bias voltage is increased, the potential contrast becomes extremely low, and this inevitably results in a reduction in the density or contrast of the resulting image. According to this invention, by maintaining the dielectric constant of the toner at a high level, triboelectrical charging between the amorphous silicon photosensitive material and the toner can be suppressed and the bias voltage to be applied can be set at a low value. Consequently, an image of high contrast can be formed while preventing fogging.

Furthermore, as stated above, the field strength of the space between the magnetic brush and the photosensitive material to which the toner is adhering becomes high. Hence, the time required for movement of the toner becomes short and the development time can be considerably shortened. By combining the toner with the aforesaid ferrite carrier having an excellent ability to impart a charge to the toner, a developer suitable for high-spaced development can be prepared. The ability of the developer to form an image of high density can be maintained even the surface potential of the amorphous silicon photosensitive material having no high charging characteristics is lowered due to an increase in the rotating speed of the photosensitive drum in high-speed copying. Needless to say, this developer can also give images of excellent quality when used for low to medium speed copying.

In view of its transferability, the toner used should have an electric resistance of at least $1\times10^{13}$ ohms-cm, preferably at least $5\times10^{13}$ ohms-cm. Furthermore, as a matter of course, this toner should be a colored toner having chargeability and fixability.

Various means can be employed for maintaining the dielectric constant ($\epsilon$) of the toner at a high level in this invention. Most conveniently, a method is used in which a high dielectric material or an electrically conductive substance is dispersed in the form of fine particles in the toner particles.

Suitable high dielectric materials are those having moisture resistance and water resistance. Examples include $TiO_2BaTiO_3$, solid solutions of titanates such as $BaTiO_3$-$SrTiO_3$, $BaTiO_3$-$PbTiO_3$, $BaTiO_3$-$CaTiO_3$ and $BaTiO_3$-$YTiO_3$, and solid solutions of titanates and other salts such as $BaTiO_3$-$BaSnO_3$, $BaTiO_3$-$BaZrO_3$ and $PbTiO_3$-$PbZrO_3$.

Preferably, these high dielectric materials are included in the form of a fine powder into the toner particles in an amount of 1 to 20% by weight. especially 1.5 to 10% by weight. If the content of the high dielectric material is smaller than the specified lower limit, it is difficult to limit the specific inductive capacity of the toner to the range specified in this invention. On the other hand, if it exceeds the upper limit specified above, the color of the toner may sometimes become undesirable. This is because such high dielectric materials as $TiO_2$ and $BaTiO_3$ are white pigments and excessively large amounts of these dielectrics reduce the black tone of the toner. It is preferred therefore to use a black dielectric material, and the use of black titanium oxide is especially preferred. Examples of the black titanium oxide are those sold by Mitsubishi Metal Co., Ltd. under tradenames Tital Black 20M, and Titan Black 12S. the Titan Blacks are represented by the general formula $Ti_nO_{2n-1}$. Since n is near 1, the stoichiometry (the ratio fo the number of atoms) of Ti and 0 is near 1:1.

From the standpoint of increasing the specific inductive capacity of the toner particles, it is also advantageous to include electrically conductive fine particles such as carbon black either in combination with the high dielectric material or singly. The inclusion of the conductive particles such as carbon black into the toner particles tends to lower the electric resistance of the toner particles depending upon the amount of the conductive particles. When incorporated into a resinous medium, carbon black is liable to assume a chain structure, and in this case, the electric resistance of the toner particles is reduced especially remarkably. Accordingly, when an ordinary carbon black is used as such, its amount should be limited to not more than 10% by weight. However, a surface-treated carbon obtained by treating the surface of carbon black with a surface-active agent, a metal soap, etc. or a so-called graft carbon obtained by grafting an ethylenically unsaturated monomer to the surface of carbon black can be used in an amount of up to 15% by weight because such a treated carbon black has increased dispersibility in a resin medium and the formation of a chain structure is prevented.

Thermoplastic resins, uncured thermosetting resins, and initial condensates of thermoplastic resins are used as the resin. Suitable examples include, in order of decreasing importance, vinyl aromatic resins such as polystyrene, acrylic resins, polyvinyl acetal resins, polyester resins, epoxy resins, phenolic resins, petroleum resins and olefin resins. As coloring pigments, one or more fo carbon black Cadmium Yellow, Molybdenum Orange, Pyrazolone Red, Fast Violet B and Phthalocyanone Blue may be used. As required, oil-soluble dyes such as Nigrosine Base (CI50415), Oil Black (CI26150) and Spiron Black, metal naphthenates, fatty acid metal soaps, resin acid soaps, etc. may be used as a charge controlling agent.

The toner particles used in this invention generally has a particle diameter of 5 to 20 micrometers.

From the standpoint of an image contrast with respect to a latent electrostatic image of low potential and the durability of the developer, it is preferred that the toner particles be substantially free from particles having a median size of 10 to 14 micrometers and a particle size of not more than 5 micrometers.

It has previously been known to use a chargeable toner having a particle diameter of 5 to 35 micrometers for a two-component developer. However, toners prepared by a known pulverizing and classifying method necessarily contain fine particles having a particle diameter of less than 5 micrometers, although it is said that the particle diameter is adjusted to 5 to 35 micrometers. The content of fine particles of less than 5 micrometers in diameter still reaches 0.5 to 2% by volume.

In contrast, in the preferred embodiment of this invention, the median size of the toner particles is adjusted to 10 to 14 micrometers, particularly 12 to 13 micrometers, and the content of particles having a particle diameter of not more than 5 microns is restricted to substantially zero. The expression "being substantially free from particles having a particle diameter of not more than 5 micrometers" or the "content of particles having a particle diameter of not more than 5 micrometers is restricted to substantially zero" means that the particles having a particle diameter of not more than 5 micrometers cannot be detected by commercially used particle size analyzing techniques, such as the Coultor counter method.

From the aforesaid standpoint, in order to form an image of high density from an electrostatic image of low potential contrast on the amorphous silicon photosensitive material, it is a very critical and effective means to restrict the content of toner particles having a particle diameter of not more than 5 micrometers to substantially zero.

Figure 6:
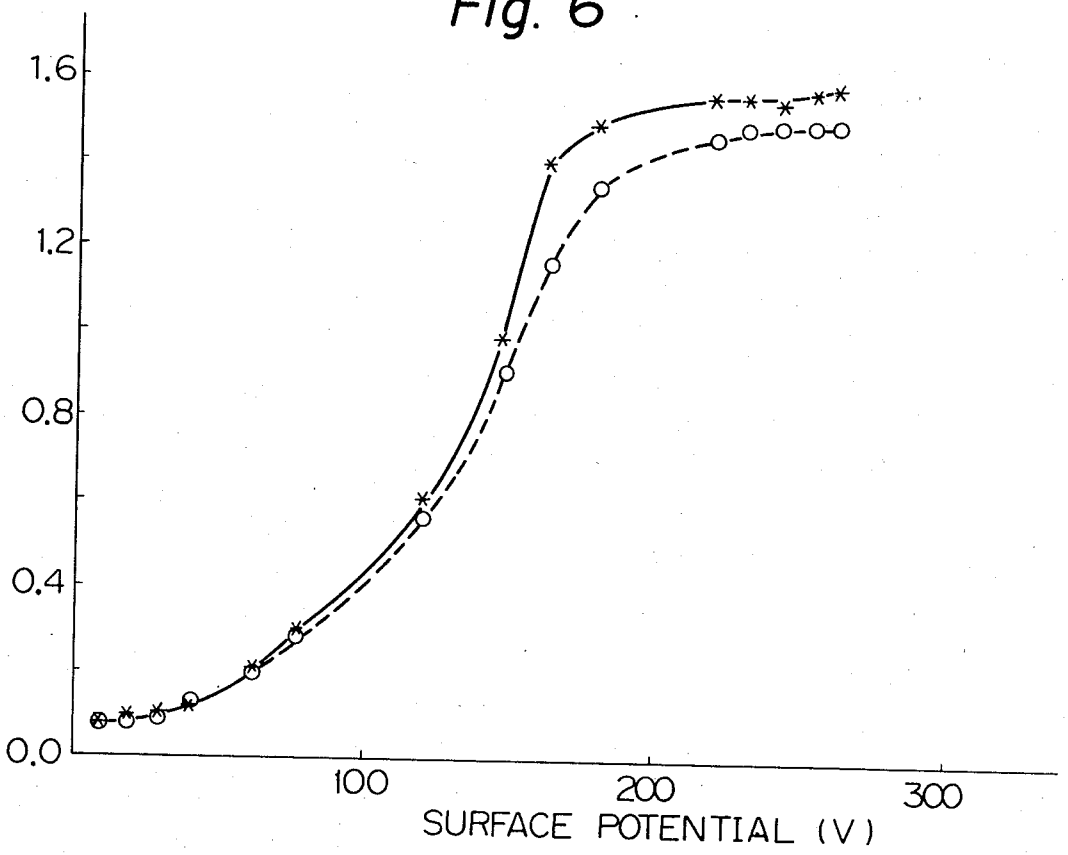
FIG. 6 is a graphic representation showing the relation between the surface potential of an amorphous silicon photosensitive material and the image density.

This criticality is clear from the graphic representation of FIG. 6. In FIG. 6, the surface potential of the amorphous silicon photosensitive material is taken on the abscissa, and the image density, on the ordinate. The plotting marked by circles refers to the case of using a toner (specific inductive capacity 5.1) containing 0.8% by volume of particles having a particle diameter of not more than 5 micrometers; and the plotting marked by asterisks refers to the case of using a toner (specific inductive capacity 5.1) substantially free from particles having a particle diameter of not more than 5 micrometers. It is evident from FIG. 6 that an image of high density can be formed over a wide surface potential range by using a toner having a high dielectric constant and being substantially free from particles having a particle diameter of not more than 5 micrometers. This fact has been recognized for the first time with regard to an amorphous silicon photosensitive material having a low potential contrast, and has not been recognized, nor even anticipated, in the case of a selenium photosensitive plate which has a high potential contrast.

Figure 7:
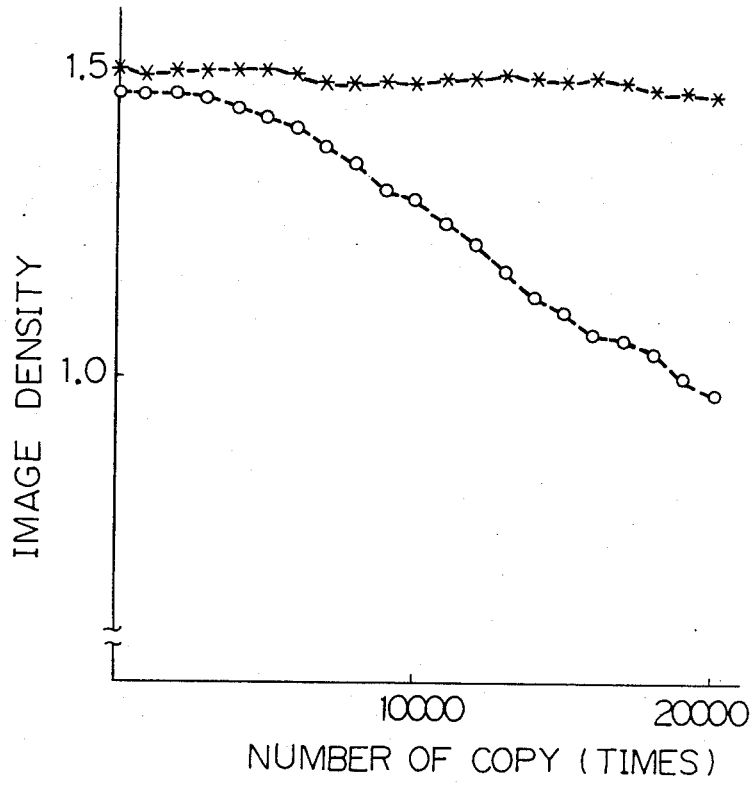
FIG. 7 is a graphic representation showing the relation between the image density and the number of copies continuously produced by using the developer of this invention.

FIG. 7 is a graphic representation in which the number of copies continuously produced is taken on the abscissa, and the image density, on the ordinate. The plottings marked by circles and asterisks have the same meaning as those in FIG. 6. It is understood from FIG.

7 that the restriction of particles having a paritcle diameter of not more than 5 micrometers to substantially zero is very critical in suppressing the tendency of the image density to decrease with time.

By restricting the content of particles having a particle diameter of not more than 5 micrometers to substantially zero, it is possible to increase the flowability of the developer and thus further improve operability in development.

Hence, the use of such a toner from which fine particles have been removed is an effective means in high-speed copying.

To restrict the content of particles having a particle diameter of not more than 5 micrometers to substantially zero, the toner obtained by the kneading and pulverizing method may be subjected to a high precision classifying operation, for example to two or more classifying operations.

Two-Component Developer

Advantageously, the ferrite carrier and the chargeable toner are used generally in a weight ratio of from 100:3.6 to 100:11. This weight ratio also exerts an effect on the electric resistance of the magnetic brush of the developer. Specifically, if the proportion of the ferrite carrier increases, the electric resistance of the magnetic brush tends to decrease. The optimum weight ratio of the two has closely to do also with the specific surface areas of the ferrite carrier and the chargeable toner. In a preferred embodiment of this invention, the development is carried out such that the concentration (Ct %) of the toner in the developer forming the magnetic brush signifies the following equation $$Ct = k \cdot \frac{Sc}{St + Sc} \times 100 \quad (2)$$

wherein Sc is the specific surface area ($cm^2/g$, actually measured by the transmission method) of the ferrite carrier, St is the specific surface area ($cm^2/g$: the effective specific surface area calculated on the basis of the average particle diameter measured by usng a Coultor counter, on the assumption that the toner particles are true spheres; let the radius obtained from the average particle diameter be r (cm and the true specific gravity of the toner be $\rho(g/cm^3)$, it is calculated in accordance with the equation $St=2/r\cdot\rho$) of the toner, and k is a number of from 0.80 to 1.07.

In equation (2), the term Sc/(St+Sc) on the right side relates to the specific surface areas of the carrier and the toner. Specifically, it is a value expressing the proportion of the surface area of the carrier based on the total surface area of a mixture of equal weights of the carrier and the toner (to be referred to as the carrier surface occupancy ratio).

In this embodiment of the present invention, when an electrostatic image is developed with the two-component developer under conditions such that the concentration of the toner becomes equal to this carrier surface occupancy ratio or a value close to it. The density of the resulting image is increased simultaneously with a decrease in fog density, an increase in resolution and an improvement in gradation.

The difference between the concentration of the toner (Ct %) and the carrier surface occupancy ratio (Sc/(Sc+St), %) can be evaluated by determining the ratio of the two, namely the coefficient k of the following formula $$k = Ct/(Sc/(St+Sc)).$$

The coefficient k differs depending upon the shape of the ferrite carrier used. In the present invention, by adjusting the coefficient k to 0.80 to 1.07, epsecially 0.90 to 1.04 for spherical ferrite particles, it is possible to obtain a high image density, a low fog density, a high resolution and excellent gradation. In addition, this achieves the advantage that these characteristics are hardly deteriorated not only in the initial stage of development, but also even after 40,000 copies have been continuously produced.

Photosensitive Material

The two-component developer of this invention is especially useful for development in an electrophotographic process using an amorphous silicon-type photoconductor layer.

The amorphous silicon-type photoconductor used may be any of those which are known per se. For example, amorphous silicon precipitated on a substrate by plasma decomposition of a silane gas is used. It may be doped with hydrogen, halogen, or an element of Group III or V of the periodic table such as boron or phosphorus.

A typical amorphous silicon photosensitive material has a dark conductivity of $\lesssim 10^{12}$ $ohm^{-1}\cdot cm^{-1}$, an activation energy of less than 0.85 eV, a photoconductivity of more than $10^{-7}$ $ohm^{-1}\cdot cm^{-1}$, and an optical band gap of 1.7 to 1.9 eV, and contains 10 to 20 atomic % of hydrogen bonded. A film of this material has a dielectric constant of 11.0 to 12.5.

The amorphous silicon photoconductor layer can be positively or negatively charged depending upon the type of the doping species. Generally, the voltage applied to the corona discharge device is 5 to 8 KV.

The present invention has the marked advantage that an image of a high density and high quality can be formed even when the film thickness of the amorphous silicon photoconductor layer is as small as 10 to 35 micrometers and consequently its charge potential is extremely low. The usability of the photosensitive layer of a small film thickness is very advantageous in decreasing the cost of the photosensitive material, and moreover makes it possible to prevent light scattering in the photosensitive layer. As a result, the resulting toner image has an increased resolution.

According to this invention, a high image density can be obtained, and copies of good resolution can be obtained, even when the potential of a latent electrostatic image formed on the surface of the photosensitive drum is lowered as a result of the increased speed of copying and therefore the increased rotation speed of the drum.

The two-component developer of this invention is, of course, effective also for developing charge images formed on photoconductive layers other than the amorphous silicon photoconductor, for example a selenium photosensitive plate, a CdS photosensitive plate or an organic photosensitive plate (OPC). In this case, too, the developer of the invention has the advantage that a toner image free from carrier migration or an edge effect can be formed in a high density even from a charge image of a low potential contrast.

The following Examples illustrate the present invention more specifically.

EXAMPLE 1

Three types of toner having different dielectric constants and two types of carrier having different apparent densities were combined to prepare developers. A copying test was conducted using these developers.

Copying machine

A copying machine equipped with the various mechanisms shown in FIG. 1 was used under the following conditions.

Photosensitive material: a photosensitive material prepared by depositing α-Si:H doped with boron to a thickness of 20 micrometers on an aluminum substrate having a diameter of 90 mm by glow discharge decomposition.

Light source for image exposure: a white fluorescent lamp having a light intensity on the surface of the photosensitive material set at 60 $\mu W/cm^2$ the spectral intensity at 600 nm or more was set at not more than 10 $\mu W/cm^2$).

Light source for charge elimination: a cold cathode discharge tube emitting green light.

Cleaning: blade cleaning method

Main charging: corona discharger (+6.2 V applied)

Transfer charging: corona discharger (+5.7 KV applied)

Copying speed: the rotating speed of the photosensitive drum, 16 cm/sec (20 copies (A4 size)/min)

Development:

Sleeve rotating speed: 23 rotations/sec.

Magnet intensity: 1000 gauss

Brush clearance: 1.0 mm

Development region: Both the photosensitive drum and the development sleeve were rotated clockwise, and the gap between D and S was fixed at 1.5 mm.

Preparation of toners

A mixture having each of the compositions shown in Table 1 was fully kneaded and dispersed in the molten state by a hot three-roll mill. The kneaded mixture was then taken out, and cooled. It was coarsely pulverized to a size of about 2 mm, and then finely pulverized by a jet mill. The pulverized particles were classified to provide a particle size distribution of 5 to 20 microns. Then, 0.1% of hydrophobic silica (R-972, a product of Japan Aerosil Co., Ltd.) was added and mixed to treat the surface of the particles with silica. Thus, a toner was obtained.

TABLE 1

| Toner No. | Composition (parts by weight) Styrene/acrylic resin | Carbon black | Negative charge controlling agent | Black titanium oxide |
|---|---|---|---|---|
| 1 | 500 | 40 | 5 | 0 |
| 2 | 310 | 40 | 5 | 10 |

TABLE 1-continued

| Toner No. | Composition (parts by weight) Styrene/acrylic resin | Carbon black | Negative charge controlling agent | Black titanium oxide |
|---|---|---|---|---|
| 3 | 510 | 50 | 5.5 | 20 |

The electrical properties of the resulting toners are shown in Table 2. These properties were measured under the following conditions.

Interelectrode distance: 0.65 mm

Cross-sectional area of the electrodes: 1.43 $cm^2$

Load between the electrodes: 105 $g/cm^2$

In toner preparation barium titanate may be added as the high dielectric material instead of black titanium oxide. Alternately, by increasing the amount of carbon black, the specific inductive capacity of the toner can likewise be adjusted.

TABLE 2

| Toner No. | Volume inherent resistivity (ohms-cm) | Dielectric constant | Average particle diameter corresponding to a volume of 50% (micrometers) | Specific surface area of the toner ($cm^2/g$)* |
|---|---|---|---|---|
| 1 | $8.6 \times 10^{14}$ | 3.4 | 12.1 | 4238 |
| 2 | $7.0 \times 10^{14}$ | 4.5 | 12.2 | 4203 |
| 3 | $5.0 \times 10^{14}$ | 5.1 | 12.2 | 4168 |

*Calculated value obtained by the method described hereinabove in the specification.

Carrier

Carriers A and B having an average particle diameter of about 45 micrometers (200/300 mesh) shown in Table 3 were used.

TABLE 3

| Carrier | A | B |
|---|---|---|
| D-S resistance (ohms) | $3.0 \times 10^5$ | $3.3 \times 10^5$ |
| Specific surface area ($cm^2/g$)* | 421 | 303 |
| Apparent density | 2.36 | 2.72 |

*Measured value obtained by the transmission method.

The D-S resistance of the carrier was calculated from the current value measured by applying a voltage of 20 V between the drum and the development sleeve in the aforesaid copying machine under the same conditions as described above except that an aluminum electrode drum was mounted instead of the photosensitive drum.

Two-component developers

The concentration of the toner was adjusted in relation to the specific surface areas of the toner and the carrier. The experimental results are shown in Table 4.

In the present example, the image densities and resolutions of the copies were measured. To make a clear comparison of the measured values, the development bias voltage was properly changed according to the developer so as to remove fog from the nonimage area. The bias voltage are also shown in Table 4.

TABLE 4

| | Combination of the toner and the carrier 1-A | 1-B | 2-A | 2-B | 3-A | 3-B |
|---|---|---|---|---|---|---|
| Image density | 1.20 | 1.12 | 1.42 | 1.17 | 1.46 | 1.10 |
| Resolution (lines/mm) | 6.3 | 6.3 | 6.3 | 6.3 | 6.3 | 5.6 |
| Bial voltage (+V) | 80 | 110 | 70 | 90 | 60 | 80 |

TABLE 4-continued

| | Combination of the toner and the carrier | | | | | |
|---|---|---|---|---|---|---|
| | 1-A | 1-B | 2-A | 2-B | 3-A | 3-B |
| Remarks | ID low | ID low | | ID low | | ID low |

Note: The combination is the toner/the carrier. The bias voltage denotes the reverse bias voltage for removing the fog density.

As shown by the experimental results in Table 4, with the developers 1-B and 2-B, the bias voltage has to be applied more then necessary in order to remove fog, and consequently, the image density was low.

With the combinations 2-A and 3-A, the bias voltage was low, and the images obtained were of good quality. Hence, it is seen that a combination of a toner having a high dielectric constant and a carrier having a low apparent density is effective.

EXAMPLE 2

Toner No. 3 (Table 2) used in Example 1 was repeatedly classified until the content (% by volume) of fine particles having a particle diameter of not more than 5 micrometers became substantially zero (the product is referred to as the fine powder cut toner). The particle size distributions of the fine powder cut toner and a normal toner are shown in Table 5.

TABLE 5

| Particle size distribution (micrometers) | Fine powder cut toner | Normal toner |
|---|---|---|
| less than 5.04 | 0 | 0.7 |
| 5.04–10.08 | 20.1 | 26.1 |
| 10.08–16.0 | 69.6 | 57.8 |
| 16.0–20.2 | 10.0 | 12.8 |
| more than 20.2 | 12.2 | 12.18 |

(The particle size distribution was measured by a commercial Coulter counter.)

The two toners were each mixed with the carrier (A in Table 3) of Example 1 so as to provide a proper toner concentration having regard to the specific surfaces of the carrier and the toner. By using the resulting developers, a copying test was carried out as in Example 1. The results are shown in Table 6.

TABLE 6

| | Fine powder cut toner | Normal toner |
|---|---|---|
| Concentration of the toner (wt. %) | 8.96 | 8.96 |
| D-S resistance of the developer | $16.0 \times 10^6$ | $16.5 \times 10^6$ |
| Image density | 1.52 | 1.46 |
| Brush marks | none | none |
| Resolution (lines/mm) | 6.3 | 6.3 |
| Gradation (*) | | |

(*) See the note below Table 7.

As shown in Table 6, the fine powder cut toner gave a higher image density than the normal toner. This is presumably because the distribution of the amount of charge of the toner was shifted to a relatively easily developable condition due to the cutting off of the fine powder.

It has thus been made clear that the cutting off of a fine powder having a particle diametre of not more than 5 micrometers favorably affects the increasing of the image density, and that the use of the carrier together with a toner having a high dielectric constant and being free from the fine powder is effective.

EXAMPLE 3

Several developers were prepared by mixing the fine powder cut toner having a high dielectric constant used in Example 2 with the same carrier as used in Example 2 with varying resistance values as shown in Table 7. A copying test was conducted using these developers, and the results are shown in Table 7.

It is seen from Table 7 that developer A containing the carrier having two low an electrical resistance and a DOS resistance of less than $4\times10^6$ ohms and gave an image having brush marks and poor gradation and resolution.

By using the fine powder cut toner having a high dielectric constant, developers B to F could give images of high densities and high qualities over a very broad D-S resistance range of from $4\times10^6$ to $5\times10^7$ ohms. However, when the D-S resistance of the developer exceeds $5\times10^7$ ohms, the image density abruptly decreases, and the copy becomes useless as in the case of using developer G.

The foregoing results demonstrate that by using the fine powder cut toner having a high dielectric constant and a carrier having an apparent density of not more than 2.6 g/cm$^3$ and contain many raised and depressed portions on its surface, an electrostatic image of a low potential can be developed over a very broad range of the resistance of the developer, i.e. the resistance of the carrier.

TABLE 7

| | Developers prepared from the fine powder cut toner having a high dielectric constant | | | | | | |
|---|---|---|---|---|---|---|---|
| Developer designation | A | B | C | D | E | F | G |
| D-S resistance of the carrier (ohms) | $4 \times 10^4$ | $8 \times 10^4$ | $10 \times 10^4$ | $35 \times 10^4$ | $71 \times 10^4$ | $303 \times 10^4$ | $851 \times 10^4$ |
| Specific surface area of the carrier (cm$^2$/g) | 401 | 429 | 390 | 378 | 412 | 390 | 386 |
| Concentration of the toner (%) | 8.30 | 8.82 | 8.09 | 7.86 | 8.50 | 8.08 | 8.01 |
| D-S resistance of the developer | $2.8 \times 10^6$ | $6.1 \times 10^6$ | $14.4 \times 10^6$ | $19.1 \times 10^6$ | $40.0 \times 10^6$ | $48.3 \times 10^6$ | $83.2 \times 10^6$ |
| Image density (ID) | 1.16 | 1.44 | 1.53 | 1.52 | 1.51 | 1.29 | 1.09 |
| Brush marks (*) | X | O | O | O | O | O | O |
| Resolution | 4.5 | 4.5 | 5.0 | 6.0 | 6.0 | 6.0 | 6.0 |

TABLE 7-continued

| Developers prepared from the fine powder cut toner having a high dielectric constant | | | | | | | |
|---|---|---|---|---|---|---|---|
| Developer designation | A | B | C | D | E | F | G |
| Gradation (**) | X | Δ | Δ | O | O | Δ | X |

(*) The occurrence of brush marks was evaluated on the following scale.
X: many brush marks, Δ: some brush marks, O: no brush marks
(**) Gradation was evaluated on the following scale.
X: A low-density area could not be reproduced.
Δ: A low-density area could be reproduced, but a high-density area lacked gradation.
O: There was gradation from the low-density area to the high-density area.

ID in Table 7 represents the reflection density of an image which was obtained by developing a solid portion having a photosensitive surface potential of 250 V by applying a development bias voltage of 80 V and transferring the developed image.

EXAMPLE 4

A copying test was conducted using the developer D used in Example 3 in a copying machine having a copying speed of 50 sheets (A4 size)/min. The resulting copies had an image density of 1.48, a resolution of 6 lines/mm and excellent gradation.

The conditions for the copying machine used in this example were as follows: The rotating speed of the drum was 35 cm/sec and the rotating speed of the sleeve was 105 cm/sec. The drum and the sleeve were rotated so that in the developing zone, they moved in the same tangential direction. The magnet strength was 800 gauss. The development was carried out while maintaining the brush clearance at 1.0 mm and the drum-sleeve distance at 1.0 mm.

Under these developing conditions, the D-S resistance of the developer was $18.8\times10^6$ ohms (50 V applied), and the D-S resistance of the carrier was $27\times10^4$ ohms (20 V applied).

What is claimed is:

1. A two-component electrophotographic developer composed of a mixture of (a) a magnetic carrier of spherical sintered ferrite particles having raised and depressed portions attributed to the primary particles on their surface, a median size of from 30 to 50 micrometers, an apparent density of less than 2.6 g/cc and an electric resistance, measured in the form of a magnetic brush, of from $6\times10^4$ to $2.5\times10^6$ ohms, and (b) chargeable toner particles having a volume inherent resistivity of at least $1\times10^{13}$ ohms-cm and a specific inductive capacity of from 4 to 6 said toner particles being substantially free from particles having a particle diameter of not more than 5 micrometers.

2. A two-component electrophotographic developer composed of a mixture of (a) a magnetic carrier of spherical sintered ferrite particles having raised and depressed portions attributed to the primary particles on their surface, a median size of from 30 to 50 micrometers, an apparent density of less than 2.6 g/cc and an electric resistance, measured in the form of a magnetic brush, of from $6\times10^4$ to $2.5\times10^6$ ohms, and (b) chargeable toner particles having a volume inherent resistivity of at least $1\times10^{13}$ ohms-cm and a specific inductive capacity of from 4 to 6, said toner particles having a median size of from 10 to 14 micrometers and being substantially free from particles having a particle diameter of not more than 5 micrometers.

3. The developer of claim 1 wherein the weight ratio of the ferrite carrier (a) to the chargeable toner (b) is from 100:3.6 to 100:11.

4. The developer of claim 1 wherein the concentration, Ct %, of the toner particles (b) in the mixture is represented by the following equation $$Ct = k \cdot \frac{Sc}{St + Sc} \times 100$$

wherein Sc is the specific surface area ($cm^2/g$) of the ferrite carrier (a), St is the specific surface area ($cm^2/g$) of the toner particles (b), and k is a number of from 0.80 to 1.07.

5. The developer of claim 1 wherein the ferrite carrier (a) has an electric resistance, measured in the form of a magnetic brush, of from $1.0\times10^5$ to $7.2\times10^5$ ohms.

6. The developer of claim 1 wherein the ferrite carrier (a) has a median size of from 40 to 45 micrometers.

7. The developer of claim 1 wherein the ferrite carrier (a) has an apparent density of from 2.30 to 2.50 g/cc.

8. The developer of claim 1 wherein the ferrite particles (a) are particles of a Cu-Zn type or Cu-Zn-Mn type ferrite composed of 35 to 65 atomic % by weight of Fe, 5 to 15 atomic % by weight of Cu, 5 to 15 atomic % by weight of Zn and 0 to 0.5 atomic % by weight of Mn.

9. The developer of claim 8 wherein the ferrite particles are obtained by sintering said ferrite at a temperature of 900° to 1100° C.

10. The developer of claim 1 wherein the toner particles (b) have a volume inherent resistivity of at least $5\times10^{13}$ ohms-cm.

11. The developer of claim 1 wherein the toner particles (b) have a particle diameter of 5 to 20 micrometers.

12. The developer of claim 1 wherein the toner particles (b) contain 1 to 20% by weight of a high dielectric material in the form of a fine powder.

13. The developer of claim 12 wherein the high dielectric material is black titanium oxide.

14. The developer of claim 2 wherein the toner particles (b) are substantially free from particles having a median size of from 12 to 13 micrometers and a particle diameter of not more than 5 micrometers.

* * * * *